US010322312B1

(12) United States Patent
Danford

(10) Patent No.: US 10,322,312 B1
(45) Date of Patent: Jun. 18, 2019

(54) RESISTANCE AND FILTRATION BREATHING DEVICE

(71) Applicant: TrainingMask L.L.C., Cadillac, MI (US)

(72) Inventor: Casey Danford, Cadillac, MI (US)

(73) Assignee: TrainingMask L.L.C., Cadillac, MI (US)

( * ) Notice: Subject to any disclaimer, the term of this patent is extended or adjusted under 35 U.S.C. 154(b) by 0 days.

(21) Appl. No.: 15/996,098

(22) Filed: Jun. 1, 2018

(51) Int. Cl.
*A62B 18/10* (2006.01)
*A62B 23/02* (2006.01)
*A63B 23/18* (2006.01)

(52) U.S. Cl.
CPC ..... *A63B 23/18* (2013.01); *A62B 18/10* (2013.01); *A62B 23/025* (2013.01)

(58) Field of Classification Search
CPC ..... A63B 21/00058; A63B 21/00069; A63B 21/00076; A63B 21/00185; A63B 21/008; A63B 21/0085; A63B 21/0088; A63B 21/065; A63B 21/4003; A63B 21/4039; A63B 21/4045; A63B 21/4047; A63B 21/4049; A63B 23/025; A63B 23/03; A63B 23/032; A63B 23/18
See application file for complete search history.

(56) References Cited

U.S. PATENT DOCUMENTS 938,247 A 10/1909 Kuhn
2,406,888 A 9/1946 Meidenbauer, Jr.
3,097,642 A 7/1963 Russell
3,474,783 A * 10/1969 Ulmann ..... A62B 18/10 128/206.15

(Continued)

FOREIGN PATENT DOCUMENTS

CN 104705842 A 6/2015
EM 000590377-0004 A 11/2007

(Continued)

OTHER PUBLICATIONS

International Search Report and Written Opinion dated Dec. 7, 2015, issued in International (PCT) Patent Application No. PCT/US2015/051364, filed Sep. 22, 2015 (15 pages).

(Continued)

*Primary Examiner* — Gary D Urbiel Goldner
(74) *Attorney, Agent, or Firm* — Greenberg Traurig, LLP

(57) ABSTRACT

A resistance breathing device includes a face mask having an inlet aperture, an intake restricting element having an inlet aperture, and an adjustment mechanism, the intake restricting element positioned adjacent to the face mask and rotatable between a first position, in which a first portion of the inlet aperture of the intake restricting element overlays a first portion of the inlet aperture of the face mask, and a second position, in which a second portion of the inlet aperture of the intake restricting element overlays a second portion of the inlet aperture of the face mask, the second portion of the inlet aperture of the intake restricting element being larger than the first portion of the inlet aperture of the intake restricting element, the adjustment mechanism attached to the face mask and movable between first and second positions corresponding to the first and second positions of the intake restricting element.

17 Claims, 10 Drawing Sheets

(56) References Cited

U.S. PATENT DOCUMENTS 3,633,575 A 1/1972 Brumfield
3,850,171 A 11/1974 Ball et al.
D246,012 S 10/1977 Minette
4,064,876 A 12/1977 Mulchi
4,221,381 A 9/1980 Ericson
4,300,240 A 11/1981 Edwards
4,549,543 A 10/1985 Moon
4,601,465 A 7/1986 Roy
4,739,987 A 4/1988 Nicholson
4,770,413 A 9/1988 Green
4,823,828 A 4/1989 McGinnis
4,961,420 A 10/1990 Cappa et al.
4,973,047 A 11/1990 Norell
5,117,821 A 6/1992 White
5,167,819 A 12/1992 Iana et al.
D340,317 S 10/1993 Cole
D369,442 S 4/1996 Jones
D380,545 S 7/1997 Nozaki et al.
5,649,533 A 7/1997 Oren
5,697,105 A 12/1997 White
5,799,652 A 9/1998 Kotliar
5,848,589 A 12/1998 Welnetz
5,850,833 A 12/1998 Kotliar
5,884,336 A 3/1999 Stout
5,924,419 A 7/1999 Kotliar
5,964,222 A 10/1999 Kotliar
6,006,748 A 12/1999 Hollis
6,070,578 A 6/2000 Baughman et al.
D434,879 S 12/2000 Cole
D440,302 S 4/2001 Wolfe
6,390,094 B1 5/2002 Slionski
6,471,621 B2 10/2002 Hörstel et al.
6,508,850 B1 1/2003 Kotliar
6,554,746 B1 4/2003 McConnell et al.
6,606,751 B1 * 8/2003 Kalhok ..... A42B 3/226 2/424
6,644,308 B2 11/2003 Kalhok et al.
6,718,969 B1 4/2004 Rubin et al.
6,986,745 B2 1/2006 Farr et al.
7,523,755 B2 4/2009 Richardson et al.
D636,128 S 4/2011 Hancock et al.
7,931,733 B2 4/2011 Kotliar
7,958,889 B1 6/2011 Fernandez-DeCastro
D645,956 S 9/2011 Grimsley
D665,903 S 8/2012 Sullivan, Jr.
D666,364 S 8/2012 Votel et al.
D670,037 S 10/2012 Chen
8,365,734 B1 2/2013 Lehman
D681,192 S 4/2013 D'Souza et al.
D681,881 S 5/2013 Pong
8,443,806 B2 5/2013 Morelli et al.
8,590,533 B2 11/2013 Danford
D694,875 S 12/2013 D'Souza et al.
8,678,005 B2 3/2014 Dawson
8,695,599 B2 4/2014 Friberg et al.
8,733,357 B2 5/2014 Sullivan, Jr.
8,746,249 B2 6/2014 Matula, Jr. et al.
9,067,086 B2 6/2015 Danford
9,333,318 B2 5/2016 Cragg et al.
D765,237 S 8/2016 Danford
D767,754 S 9/2016 Danford
9,517,315 B2 12/2016 Meyer et al.
9,579,540 B1 2/2017 Danford
9,643,048 B1 5/2017 Danford
9,707,444 B1 7/2017 Danford
9,802,079 B1 10/2017 Danford
9,878,204 B2 * 1/2018 Danford ..... A63B 23/18
D811,581 S 2/2018 Danford
D820,974 S * 6/2018 Danford ..... D24/110.1
2001/0007651 A1 7/2001 Fust
2001/0029750 A1 10/2001 Kotliar
2002/0023762 A1 2/2002 Kotliar
2002/0100893 A1 8/2002 Shultz
2002/0162556 A1 11/2002 Smith et al.
2002/0195108 A1 * 12/2002 Mittelstadt ..... A61M 16/06 128/206.15
2003/0005934 A1 1/2003 Japuntich et al.
2003/0154984 A1 8/2003 Fernandes
2004/0118405 A1 6/2004 Amante et al.
2004/0146842 A1 7/2004 Carlucci et al.
2004/0226563 A1 11/2004 Xu et al.
2005/0172968 A1 8/2005 Hishida
2006/0086360 A1 * 4/2006 Weich ..... A62B 18/10 128/207.12
2006/0201431 A1 9/2006 Peterson
2008/0092898 A1 4/2008 Schneider et al.
2008/0178884 A1 7/2008 Gerson et al.
2008/0202774 A1 8/2008 Kotliar
2008/0210240 A1 9/2008 Kotliar
2009/0239711 A1 * 9/2009 Foley ..... A63B 21/0085 482/13
2009/0320848 A1 12/2009 Steindort et al.
2010/0024826 A1 2/2010 Sullivan, Jr.
2010/0101584 A1 4/2010 Bledstein et al.
2011/0203593 A1 8/2011 Ishigami et al.
2011/0209712 A1 * 9/2011 Busch ..... A62B 9/02 128/207.12
2011/0212811 A1 9/2011 Rutten
2012/0080035 A1 * 4/2012 Guney ..... A61M 16/06 128/205.25
2012/0094806 A1 4/2012 Danford
2012/0103339 A1 5/2012 Koehler
2012/0167891 A1 7/2012 Smaller
2012/0180800 A1 7/2012 Shibata et al.
2012/0247474 A1 10/2012 Torbenson
2013/0060157 A1 3/2013 Beard
2013/0190643 A1 7/2013 Brambilla
2013/0319420 A1 12/2013 Danford
2014/0202469 A1 7/2014 Smaller
2014/0216474 A1 * 8/2014 Mittelstadt ..... A62B 18/10 128/863
2014/0224261 A1 8/2014 Tsuei
2014/0251332 A1 9/2014 Martin
2014/0261428 A1 9/2014 Chen
2015/0040907 A1 2/2015 Hakim
2015/0053206 A1 2/2015 Seppälä et al.
2015/0107596 A1 * 4/2015 Mashiko ..... A62B 18/08 128/206.15
2015/0151143 A1 * 6/2015 Langford ..... A62B 7/10 128/205.24
2015/0173436 A1 6/2015 Tsuei
2015/0231443 A1 8/2015 Halliday
2016/0089553 A1 3/2016 Dickstein et al.
2016/0129286 A1 5/2016 Danford
2016/0129287 A1 5/2016 Danford
2016/0331917 A1 11/2016 Bennett et al.
2017/0144000 A1 5/2017 Danford
2017/0172137 A1 6/2017 Wynalda, Jr.
2017/0274246 A1 * 9/2017 Danford ..... A63B 23/18

FOREIGN PATENT DOCUMENTS

EM 003165265-001 1/2016
EM 003165265-002 1/2016
EP 2425875 A1 3/2012
GB 5001809 2/2016
JP D2004-19667 4/2005
WO 00/04957 A1 2/2000
WO 2010/127161 A2 11/2010
WO 2010/127161 A3 11/2010
WO WOD082862 2/2014
WO 2014059389 A1 4/2014

OTHER PUBLICATIONS

Office Action for Applicant's related Japan Design Application No. 2016-001555, dated Jul. 5, 2016 by the Japanese Patent Office, and English-language translation thereof (4 pages).
ReBNA product catalogue published by Patent Works, Inc., obtained by the Japan National Center for Industrial Property Information and Training on Mar. 21, 2008 (1 page).

(56) References Cited

OTHER PUBLICATIONS

Design Patent Right Evaluation Report completed Jul. 4, 2016, issued by the State Intellectual Property Office of china in Applicant's related China Design Patent No. ZL201530482604.X and English-language translation thereof (18 pages).
Design Patent Right Evaluation Reported completed Jul. 4, 2016, issued by the State Intellectual Property Office of China in Applicant's related China Design Patent No. ZL201530482542.2 and English-language translation thereof (23 pages).
International Search Report and Written Opinion of the International Searching Authority, dated Aug. 8, 2016, issued by the European Patent Office in Applicant's related International Application No. PCT/US2015/064042 (11 pages).
Design Patent Right Evaluation Report dated Mar. 21, 2016, issued by the State Intellectual Property Office of China in Patent No. ZL201530349470.4 and English-language translation thereof (31 pages).
Patentability Assessment Report, completed Jul. 20, 2016, issued by the State Intellectual Property Office of China in Applicant's related China Utility Patent No. ZL2015208912778 and English-language translation thereof (15 pages).
Printouts of Phantom Athletics website http://www.phantom-trainingmask.com/en/ advertising a resistance breathing device, accessed Jan. 26, 2016 (8 pages).
Photographs of a resistance breathing device, purchased Jun. 3, 2016, along with redacted invoice for such purchase (9 pages).
Printouts of Phantom Athletics website, archived by Archive.org, available at https://web.archive.org/web/20160129132023/http://www.phantom-trainingmask.com/en/phantom-trainingmask, accessed Sep. 1, 2016 (8 pages).
Design Patent Right Evaluation Report dated Aug. 10, 2016, issued by the State Intellectual Property Office of China in Patent No. ZL201630018279.6 and English-language translation thereof (27 pages).
2015 Under Armour Future Show, Oct. 13, 2015, available at Http://www.youtube.com/watch?v=-EyX1AtkGls, accessed Jan. 11, 2017.
Do Elevation Masks Work?, Ciaran Fairman, available at Http://www.bodybuilding.com/content/do-elevation-masks-work.html, accessed Jan. 11, 2017.
Training Mask 2.0 Instructional Video With Warm Up, Jul. 24, 2014, available at Https://www.youtube.com/watch?v=uwli9S9iHLg, accessed Jan. 11, 2017.
International Search Report and Written Opinion of the International Searching Authority, dated Nov. 22, 2016, issued by the European Patent Office in Applicant's related International Application No. PCT/US2016/024498 (13 pages).
Office Action issued by the U.S. Patent and Trademark Office dated Dec. 2, 2016 in Applicant's in Applicant's U.S. Appl. No. 14/536,794 for "Scent Suppression Mask", filed Nov. 10, 2014.
Office Action issued by the U.S. Patent and Trademark Office dated Aug. 9, 2016 in Applicant's U.S. Appl. No. 14/951,837 for "Resistance and Filtration Breathing Device", filed Nov. 25, 2015.

* cited by examiner

RESISTANCE AND FILTRATION BREATHING DEVICE

FIELD OF THE INVENTION

The present invention relates to wearable breathing devices. More particularly, the present invention relates to wearable breathing masks providing air filtration and resistance to air inhalation.

BACKGROUND OF THE INVENTION

Individuals who are training for physical fitness or athletic competition may wish to improve the efficiency of their cardiovascular systems for improved health and stamina. Continued exposure to the reduced concentration of oxygen in the atmosphere at higher altitudes provides increased mass of red blood cells, improved efficiency of oxygen use by the muscles, and enhanced lung performance. Individuals may wish to be able to obtain the benefits of training in any desired setting. Individuals may further wish to train in any desired setting without being affected by the air quality present in such a desired setting.

SUMMARY OF THE INVENTION

In an embodiment a resistance breathing device includes a face mask, an intake restricting element, and an adjustment mechanism, the face mask having an interior surface, an exterior surface opposite the interior surface, and at least one inlet aperture extending from the exterior surface to the interior surface, the intake restricting element including at least one inlet aperture, the intake restricting element being movably positioned adjacent to the face mask, the intake restricting element being movable rotatably between at least a first position, wherein a first portion of the at least one inlet aperture of the intake restricting element overlays a first portion of the at least one inlet aperture of the face mask, and a second position, wherein a second portion of the at least one inlet aperture of the intake restricting element overlays a second portion of the at least one inlet aperture of the face mask, the second portion of the at least one inlet aperture of the intake restricting element being larger in size than the first portion of the at least one inlet aperture of the intake restricting element, the adjustment mechanism attached to the face mask such that the adjustment mechanism is movable between at least a first position and a second position, the first position of the adjustment mechanism corresponding to the first position of the intake restricting element, the second position of the adjustment wheel corresponding to the second position of the intake restricting element.

In an embodiment, motion of the adjustment mechanism between its first position and its second position causes corresponding motion of the intake restricting element between its first position and its second position.

In an embodiment, the resistance breathing device also includes a filter overlaying the at least one inlet aperture of the face mask. In an embodiment, the adjustment mechanism includes an adjustment wheel. In an embodiment, the intake restricting element includes a first plurality of teeth and the adjustment wheel includes a second plurality of teeth, the intake restricting element and the adjustment wheel being positioned adjacent to one another such that the first plurality of teeth of the intake restricting element meshes with the second plurality of teeth of the adjustment wheel. In an embodiment, the resistance breathing device also includes a retainer movably attached to the face mask, the retainer being movable between at least a first position, wherein the retainer retains the filter in proximity to the face mask, and a second position, wherein the retainer enables the filter to be removed from the face mask.

In an embodiment, the face mask includes a plurality of grooves formed in the exterior surface of the face mask and spaced apart from one another, the intake restricting element including an arm extending therefrom and a ridge projecting from the arm, the ridge of the intake restricting element being positioned within a first one of the plurality of grooves of the face mask when the intake restricting element is in its first position, and the ridge of the intake restricting element being positioned within a second one of the plurality of grooves of the face mask when the intake restricting element is in its second position. In an embodiment, the ridge of the intake restricting element and the plurality of grooves of the face mask are sized and shaped such that when the ridge is positioned within one of the plurality of grooves, the ridge and the one of the plurality of grooves cooperate to resist rotational movement of the intake restricting element. In an embodiment, the face mask includes a hole defining a rotational axis, the intake restricting element including a post, and the hole of the face mask receives the post of the intake restricting element such that the rotational movement of the intake restricting element with respect to the face mask is about the rotational axis of the hole. In an embodiment, the at least one inlet aperture of the face mask includes a plurality of inlet apertures and the at least one inlet aperture of the intake restricting element includes a plurality of inlet apertures, each of the plurality of inlet apertures of the intake restricting element corresponds to one of the plurality of inlet apertures of the face mask, when the intake restricting element is in its first position, a first portion of each of the plurality of inlet apertures of the intake restricting element overlays a first portion of the corresponding one of the plurality of inlet apertures of the face mask, and when the intake restricting element is in its second position, a second portion each of the plurality of inlet apertures of the intake restricting element overlays a second portion of the corresponding one of the plurality of inlet apertures of the face mask, the second portion of each of the plurality of inlet apertures of the intake restricting element being larger in size than the first portion of each of the plurality of inlet apertures of the intake restricting element.

In an embodiment, the plurality of inlet apertures of the intake restricting element is arrayed about the post of the intake restricting element in an arcuate arrangement. In an embodiment, at least one of the plurality of inlet apertures of the intake restricting element includes an annular sector shape. In an embodiment, the plurality of inlet apertures of the face mask is arrayed about the hole of the face mask in an arcuate arrangement. In an embodiment, at least one of the plurality of inlet apertures of the face mask has an annular sector shape. In an embodiment, each of the plurality of inlet apertures of the intake restricting element is identically sized and shaped to the corresponding one of the plurality of inlet apertures of the face mask.

In an embodiment, a size of the at least one inlet aperture of the intake restricting element is equal to a size of the at least one inlet aperture of the face mask. In an embodiment, the resistance breathing device also includes an air exhaust assembly configured to prevent air from passing therethrough from an external environment to an internal area of the face mask and to allow air to pass therethrough from the internal area of the face mask to the external environment. In an embodiment, the air exhaust assembly includes at least one outlet aperture positioned offset from the at least one inlet aperture of the face mask and at least one membrane, each of the at least one membrane overlaying a corresponding one of the at least one outlet aperture so as to allow air to pass through the at least one outlet aperture from the internal area of the face mask to the external environment and to prevent air from passing through the at least one outlet aperture from the external environment to the internal area.

In an embodiment, each of the at least one outlet aperture includes a biasing member extending across the one of the at least one outlet aperture of the face mask and a stem extending from a center of the biasing member and away from the face mask, wherein each of the at least one membrane has a hole extending therethrough, and wherein the stem of each of the at least one outlet aperture is positioned within the hole of the corresponding one of the at least one membrane. In an embodiment, the stem of each of the at least one outlet aperture includes a first portion adjacent the stem of biasing member and a second portion opposite the first portion of the stem, the second portion of the stem having a second diameter that is larger than the first diameter, and wherein the second portion of the stem retains the corresponding one of the at least one membrane adjacent the biasing element of the at least one outlet aperture.

BRIEF DESCRIPTION OF THE DRAWINGS

Reference is made to the following detailed description of the exemplary embodiment considered in conjunction with the accompanying drawings, in which.

DETAILED DESCRIPTION OF THE EXEMPLARY EMBODIMENTS

Figure 1:
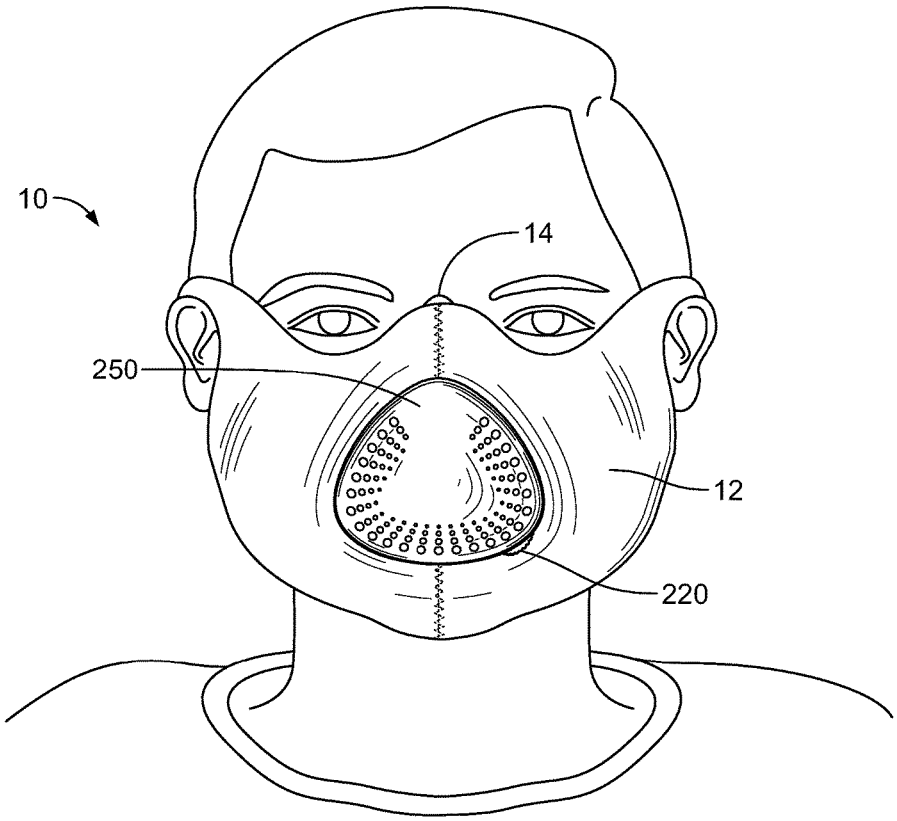
FIG. 1 is a front elevational view of a resistance and filtration breathing device in accordance with a first exemplary embodiment of the present invention, said device being shown as worn by a user.
Figure 2:
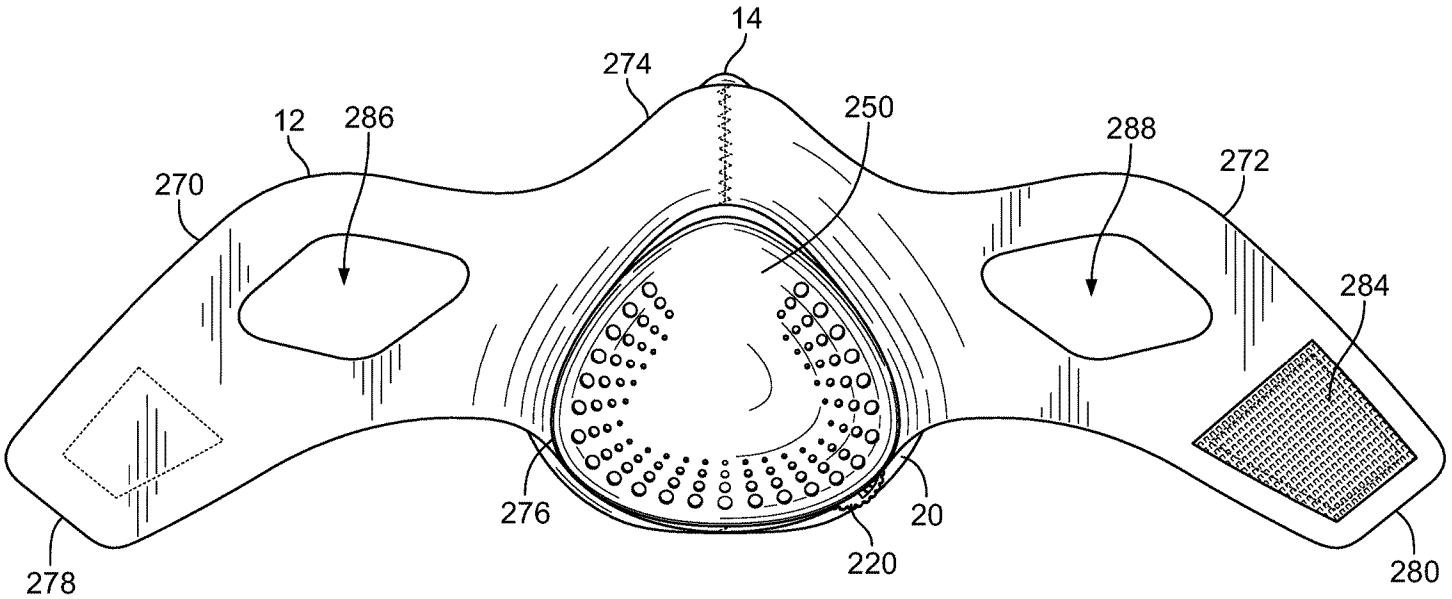
FIG. 2 is a front perspective view of the resistance and filtration breathing device shown in FIG. 1, but said device being shown as detached from the user.
Figure 3:
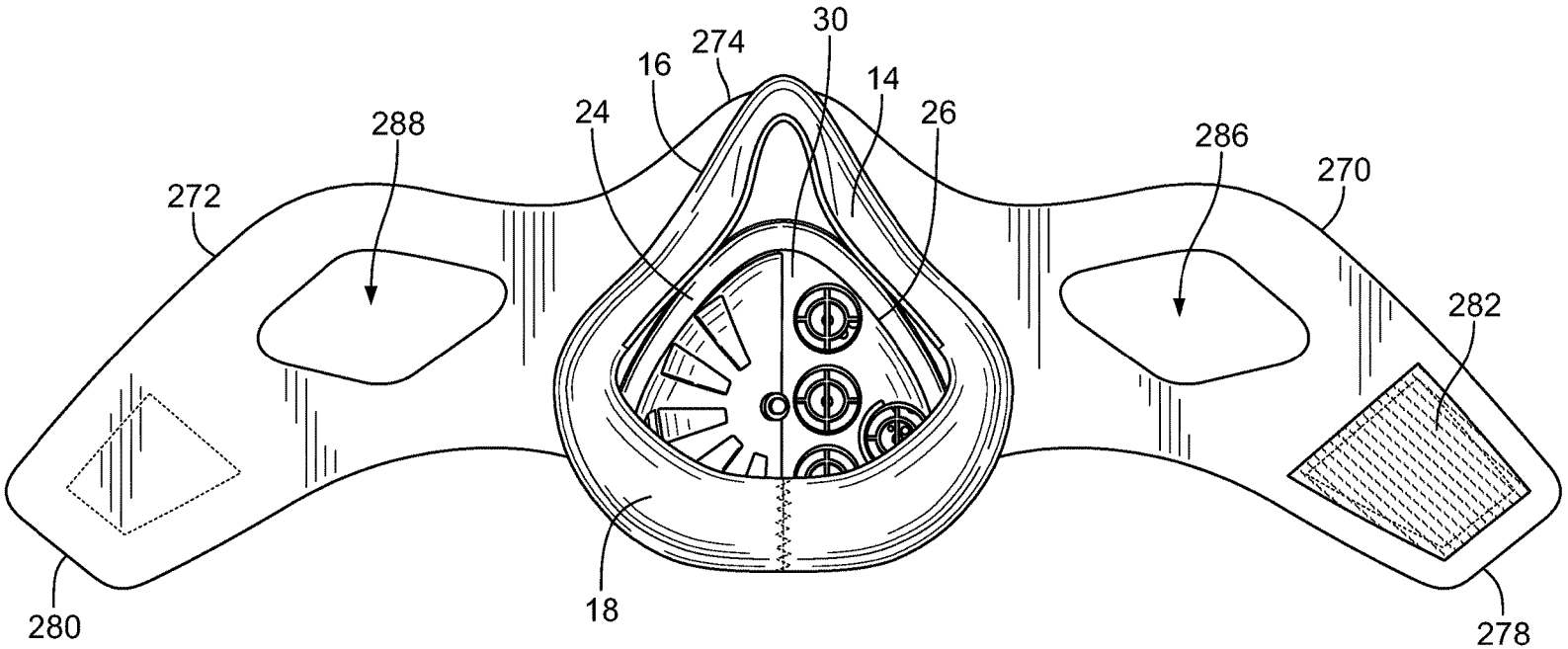
FIG. 3 is a rear perspective view of the resistance and filtration breathing device shown in FIG. 2.

FIGS. 1-6C illustrate an exemplary resistance and filtration breathing device 10 (hereinafter "device 10" for brevity). In an embodiment, the device 10 includes an outer layer 12 overlaying a centrally-located, air-impermeable face mask 14. In an embodiment, the face mask 14 is sized, shaped, and adapted to overlay the nose and mouth of a user. In an embodiment, the face mask 14 includes a perimeter 16 (as shown in FIG. 3) that is adapted to provide an air-tight seal with a user's face. In an embodiment, the face mask 14 is made from rubber. In another embodiment, the face mask 14 is made from other suitable materials known in the art selected such that the perimeter 16 provides an air-tight seal with a user's face. Referring now to FIGS. 2 and 3, in an embodiment, the face mask 14 includes an interior surface 18 and an exterior surface 20. Referring now to FIG. 4, in an embodiment, the face mask 14 includes an aperture 22 extending from the interior surface 18 to the exterior surface 20. In an embodiment, the aperture 22 is encircled by a lip 24. In an embodiment, the lip 24 includes a groove 26 formed therein and extending about the entirety thereof.

Figure 4A:
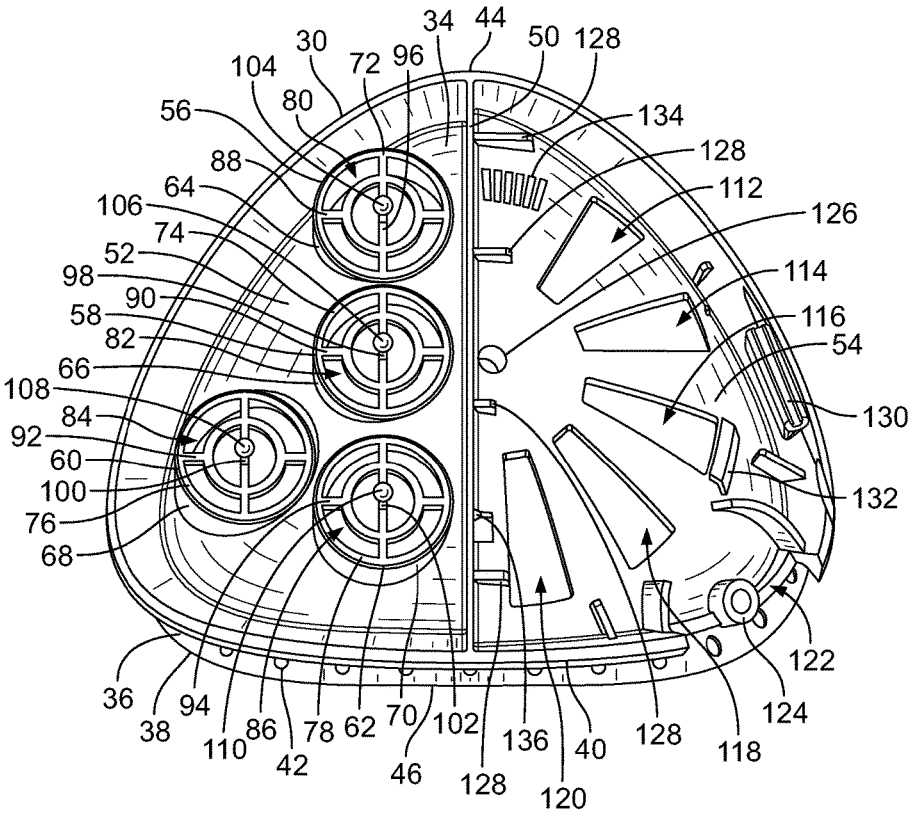
FIG. 4A is a front perspective view of selected elements of the resistance and filtration breathing device shown in FIG. 2.
Figure 4B:
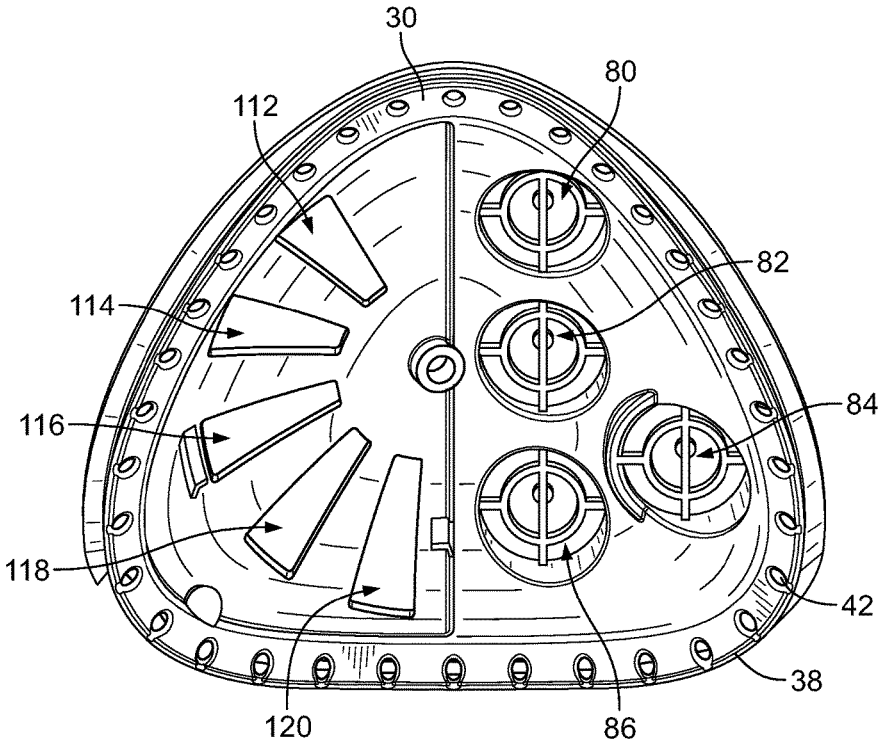
FIG. 4B is a rear perspective view of the elements shown in FIG. 4A.

Referring now to FIGS. 4A and 4B, in an embodiment, the device 10 includes an insert 30 having an interior surface 32, an exterior surface 34, and a perimeter surface 36 encircling an entire perimeter of the interior and exterior surfaces 32, 34. In an embodiment, the insert 30 has a profile similar to a rounded triangle. In an embodiment, the insert 30 has a profile similar to that of a region overlaying a person's nose and mouth. In an embodiment, an interior flange 38 extends from the perimeter surface 36 proximate the interior surface 32. In an embodiment, an exterior flange 40 extends from the perimeter surface 36 proximate the exterior surface 34. In an embodiment, an array of perforations 42 extends through the interior flange 38. In an embodiment, the interior flange 38, intermediate flange 40, and exterior flange 42 each encircle the entire perimeter surface 36. In an embodiment, the perimeter surface 36 is sized and shaped so as to be complementary with the aperture 20 of the face mask 12. In an embodiment, the interior and intermediate flanges 38, 40 are sized, shaped, and positioned so as to retain the lip 24 of the face mask 12 therebetween and form an air-tight seal therewith. In an embodiment, the insert 30 is removably inserted into the aperture 22 of the face mask 14, so as to provide such benefits as easy cleaning and interchangeability of components of the device 10.

Continuing to refer to FIGS. 4A and 4B, in an embodiment, the perimeter surface 36 includes an upper end 44 and a lower end 46. In an embodiment, a ridge 50 protrudes from the exterior surface 34, extends from the upper end 44 to the lower end 46 of the perimeter surface 36, and divides the exterior surface 34 into a first side 52 and a second side 54. In the embodiment described herein, the exterior surface 34 is divided laterally into a first portion that is a first side 52 and a second portion that is a second side 54, but it will be apparent to those of skill in the art that other types of divisions into two portions are available, including vertically, diagonally, concentrically, etc. are possible without departing from the broader principle of the exemplary device 10. In an embodiment, an indentation 138 is formed within the perimeter surface 36 at the upper end 44.

Continuing to refer to FIGS. 4A and 4B, in an embodiment, the insert 30 includes seats 56, 58, 60, 62 disposed on the first side 52 of the exterior surface 34. It will be apparent to those of skill in the art that the inclusion of four seats 56, 58, 60, 62 is only exemplary and that other embodiments of a device 10 may include a larger or smaller quantity of seats. In an embodiment, the seats 56, 58, 60, 62 include corresponding cylindrical perimeter surfaces 64, 66, 68, 70 projecting from the exterior surface 34 of the insert 30. in an embodiment, The perimeter surfaces 64, 66, 68, 70 extends to corresponding substantially planar upper surfaces 72, 74, 76, 78 having corresponding circular apertures 80, 82, 84, 86 extending therethrough from the exterior surface 34 to the interior surface 32. In an embodiment, the seats 56, 58, 60, 62 also include corresponding biasing elements 88, 90, 92, 94 disposed within the corresponding apertures 80, 82, 84, 86 and having corresponding centers 96, 98, 100, 102. In the exemplary embodiment described herein, the biasing elements 88, 90, 92, 94 are plus-shaped, but it will be apparent to those of skill in the art that other shapes are possible. In an embodiment, the seats 56, 58, 60, 62 also include corresponding posts 104, 106, 108, 110 extending from the centers 96, 98, 100, 102 of the corresponding biasing elements 88, 90, 92, 94.

Continuing to refer to FIGS. 4A and 4B, in an embodiment, the insert 30 includes apertures 112, 114, 116, 118, 120 formed within the second side 54 of the exterior surface 34 and extending therethrough from the exterior surface 34 to the interior surface 32. In an embodiment, each of the apertures 112, 114, 116, 118, 120 has a profile of an annulus sector (i.e., is the shape of a sector of an annulus). In an embodiment, the apertures 112, 114, 116, 118, 120 are arrayed in an arcuate (e.g., fan-like) shape. It will be apparent to those of skill in the art that the inclusion of five apertures 112, 114, 116, 118, 120 is only exemplary and that other embodiments of a device 10 may include a larger or smaller quantity of apertures. In an embodiment, a gap 122 is formed is formed in the exterior flange 42 at a location proximate the lower end 46 and the second side 54 of the insert 30.

In an embodiment, a post 124 extends from the second side 54 of the exterior surface 34 at or about the center of the gap 122. In an embodiment, an axial bore 125 extends through the post 124. In an embodiment, a hole 126 extends through the second side 54 of the exterior surface 34 at a location intermediate the upper and lower ends 44, 46 and proximate the ridge 50. In an embodiment, the apertures 112, 114, 116, 118, 128 are arrayed about the hole 126 in an arcuate arrangement. In an embodiment, a plurality of stops 128 extends from the second side 54 of the exterior surface 34. In an embodiment, the plurality of stops 128 includes four of the stops 128, but other numbers of the stops 128 may be present in other embodiments. In an embodiment, a clasp 130 extends from the exterior flange 42 and is located near the second side 54, intermediate the upper and lower ends 44, 46, and extending toward the ridge 50. In an embodiment, a guide 132 extends from the second side 54 of the exterior surface 34 proximate the clasp 130. In an embodiment, a plurality of grooves 134 is formed in the second side 54 of the exterior surface 34 proximate the ridge 50 and intermediate the upper end 44 and the hole 126. In an embodiment, the plurality of grooves 134 includes six of the grooves 134, but other numbers of the grooves 134 may be present in other embodiments. In an embodiment, a catch 136 projects away from the ridge 50 toward the second side 54 from a location on the ridge 50 that is proximate the lower end 46 of the perimeter surface 36. The functions of the post 124, the bore 125, the hole 126, the stops 128, the clasp 130, the guide 132, the grooves 134, and the catch 136 will be described hereinafter.

Continuing to refer to FIGS. 4A and 4B, in an embodiment, the device 10 includes flexible, air-impermeable, disc-shaped membranes 140, 142, 144, 146. Each of the membranes 140, 142, 144, 146 corresponds to one of the seats 56, 58, 60, 62; therefore, in an embodiment of a device 10 that includes a different quantity of seats, the quantity of membranes will vary accordingly. In an embodiment, the membranes 140, 142, 144, 146 include corresponding central apertures 150, 152, 154, 156, respectively, that are sized and shaped to receive the posts 104, 106, 108, 110 of the corresponding seats 56, 58, 60, 62 so as to be mounted thereon, and are sized and shaped such that, when mounted on the corresponding posts 104, 106, 108, 110, each the membranes 140, 142, 144, 146 covers the circular aperture 80, 82, 84, 86 of the corresponding one of the seats 56, 58, 60, 62.

Continuing to refer to FIGS. 4A and 4B, in an embodiment, the device 10 includes a filter 160 that is sized and shaped so as to be complementary to the second side 54 of the exterior surface 34 of the insert 30. In an embodiment, the filter 160 provides filtration of substantially all airborne particles from air inhaled and exhaled therethrough. In an embodiment, the filter 160 is a filter meeting the standards of the N100 class of filters defined by the National Institute for Occupational Safety and Health ("NIOSH"). In an embodiment, the filter 160 is capable of filtering at least 99.97% of airborne particles (e.g., dust, sand, etc.) in air passing therethrough. In an embodiment, the filter 160 includes multiple layers that are affixed to one another by a binding. In an embodiment, the binding may be formed by heat bonding. In another embodiment, the binding may include stitching. However, those of skill in the art will understand that the specific aspects of the filter 160 described above (e.g., the use of a layered construction, the quantity of layers, the manner of binding of the layers) are only exemplary and that other arrangements are possible without departing from the broader concepts embodied thereby. In an embodiment, the device 10 may include two or more different interchangeable filters 160 to enable the user to customize the degree and type of filtration provided thereby. In an embodiment, the device 10 may include two or more identical interchangeable filters 160 to enable the user to replace the filter 160 after a prescribed amount of usage, to thereby maintain adequate filtration and prevent performance degradation. In an embodiment, the device 10 may include a single filter 160, but other filters may be made separately available for replacement of the included filter 160 as described above.

Figure 5A:
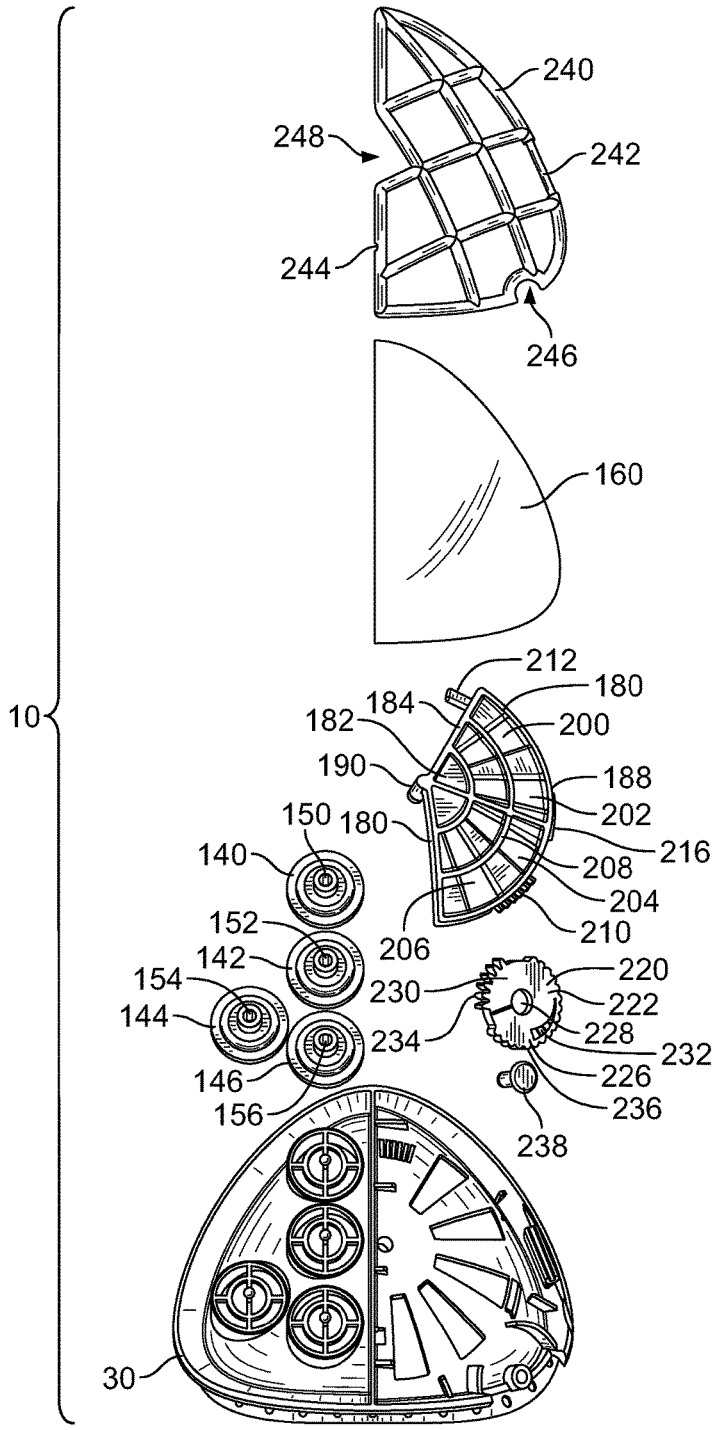
FIG. 5A is an exploded front perspective view of selected elements of the resistance breathing device shown in FIG. 2.
Figure 5B:
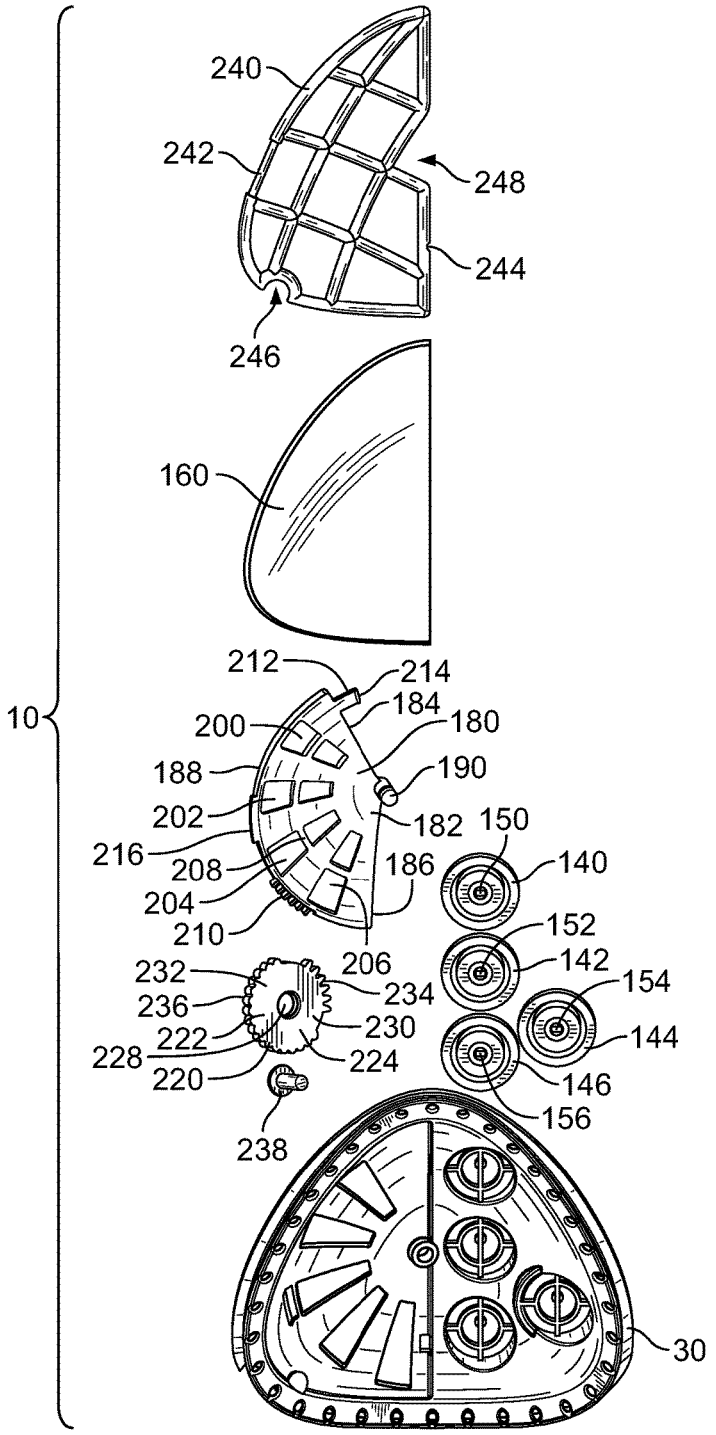
FIG. 5B is an exploded rear perspective view of the elements shown in FIG. 5A.

Referring now to FIGS. 5A and 5B, in an embodiment, the device 10 includes an intake restricting element 180. In an embodiment, the intake restricting element 180 has a body 182. In an embodiment, the body 182 has a first straight side 184, a second straight side 186, and a curved side 188 that, together, form a general profile that is shaped like a sector of a circle (i.e., the body 182 is generally wedge-shaped). In an embodiment, a post 190 extends from the body 182 of the intake restricting element 180 at a location that is approximately at the intersection of the first and second straight sides 184, 186 and in a direction that is generally perpendicular to the first and second straight sides 184, 186. In an embodiment, the post 190 is configured to be inserted into the hole 126 of the insert 30 in a manner such that the intake restricting element 180 can rotate about the hole 126. Such rotation may be described as rotation about a rotational axis extending through the hole 126 and perpendicular to the exterior surface 52 of the insert 30. In an embodiment, the post 190 may be press fit into hole 126. In an embodiment, the post 190 may be secured by forming a bulb proximate the interior surface 32 of the insert 30. In another embodiment, the insert 30 includes a post in place of the hole 126, the intake restricting element 180 includes a hole in place of the post 190, and the intake restricting element 180 may engage the insert 30 by inserting the post of the insert 30 into the hole of the intake restricting element 180.

Continuing to refer to FIGS. 5A and 5B, in an embodiment, a plurality of apertures 200, 202, 204, 206 extend through the body 182 of the intake restricting element 180. In an embodiment, each of the apertures 200, 202, 204, 206 has a profile of an annulus sector (i.e., is the shape of a sector of an annulus). In an embodiment, the plurality of apertures 200, 202, 204, 206 are arrayed about the post 190 in an arcuate (e.g., fan-like) arrangement. In an embodiment, the plurality of apertures are sized, shaped, and positioned such that, when the post 190 of the body 182 receives the post 126 of the insert 30, at least a portion of each of the apertures 200, 202, 204, 206 overlays at least a portion of a corresponding one of the apertures 112, 114, 116, 118, 120 of the insert 30. In an embodiment, each of the apertures 200, 202, 204, 206 is sized and shaped substantially identically to the corresponding one of the apertures 112, 114, 116, 118, 120 of the insert 30. In an embodiment, the size of the overlaying portions varies based on the rotational orientation of the intake restricting element 180 with respect to the insert 30. In an embodiment, a rib 208 extends circumferentially about the post 190, from the first straight side 184 to the second straight side 186, bisecting each of the apertures 200, 202, 204, 206. In an embodiment, the rib 208 is sized and shaped to strengthen and stabilize the intake restricting element 180.

Continuing to refer to FIGS. 5A and 5B, in an embodiment, a plurality of teeth 210 extends radially outward from the curved side 188 of the body 182 of the intake resisting element 180. In an embodiment, the teeth 210 are positioned such that, when the hole 126 of the insert 30 receives the post 190 of the body 182, the teeth 210 extend generally toward the post 124 of the insert 30. In an embodiment, an arm 212 extends outward from the first straight side 184 of the body 182. In an embodiment, the arm 212 is positioned proximate the curved side 188 of the body 182 and extends in a circumferential direction away from the second straight side 186 of the body 182. In an embodiment, a ridge 214 extends from the arm 212. In an embodiment, the arm 212 and the ridge 214 are sized, shaped, and positioned such that, when the hole 126 of the insert 30 receives the post 190 of the body 182, the ridge 214 is positioned generally proximate the grooves 134 of the insert 30, and may variably be aligned with one of the grooves 134, or be positioned between two adjacent ones of the grooves 134, or be positioned past a first or last one of the grooves 134, depending on the rotational alignment of the intake resisting element 180 with respect to the insert 30. In an embodiment, the arm 212 may abut the ridge 50 of the insert 30 to restrict the rotational travel of the intake resisting element 180 in one direction. In an embodiment, a fin 216 extends radially outward from the curved side 188 of the body 182. In an embodiment, the fin 216 is sized, shaped, and positioned such that, when the hole 126 of the insert 30 receives the post 190 of the body 182, the guide 132 of the insert 30 overlays the fin 216, thereby guiding rotation of the intake resisting element 180 with respect to the insert 30.

In an embodiment, rather than the grooves 134, the insert 30 may include a series of ridges positioned in the same region of the second side 54 as are the grooves 134. In such an embodiment, the ridge 214 of the arm 212 of the intake restricting element 180 may be positioned between adjacent ones of such ridges to define discrete positional settings for the intake restricting element 180. In such an embodiment, the ridge 214 of the arm 212 of the intake restricting element 180 may be aligned with various ones of such ridges to define transitions between such discrete positional settings.

Continuing to refer to FIGS. 5A and 5B, in an embodiment, the device 10 includes an adjustment wheel 220 (e.g., an adjustment mechanism). The adjustment wheel 220 includes a substantially circular body 222 having an interior surface 224 and an exterior surface 226 opposite the interior surface 224. A hole 228 extends through the body 222 and is positioned concentrically therewith. The hole 228 is sized and shaped to receive the post 124 of the insert 30 in a complementary manner, such that the adjustment wheel 220 cannot move across the exterior surface 44 of the insert 30, but can rotate with respect to the insert 30. Such rotation may be described as rotation about a rotational axis extending through the post 124 and perpendicular to the exterior surface 52 of the insert 30. The body 222 includes a first side 230 and a second side 232 opposite the first side 230. A plurality of teeth 234 extend from the first side 230 of the body 222, and are sized and shaped so as to mesh with the teeth 210 extending from the curved side 188 of the intake restricting element 180. A plurality of grips 236 extend from the second side 232 of the body 222, and are sized and shaped so as to enable a user of the device 10 to rotate the adjustment wheel 220 in a manner that will be described in further detail hereinafter. In an embodiment, indicia are printed on the exterior surface 226 of the body 222.

Continuing to refer to FIGS. 5A and 5B, in an embodiment, the device 10 includes a rivet 238. In an embodiment, the rivet 238 is configured to be fixed in the hole 125 of the insert 30.

Continuing to refer to FIGS. 5A and 5B, in an embodiment, the device 10 includes a retainer 240. In an embodiment, the retainer 240 has a profile that generally conforms to that of the second side 54 of the exterior surface 34 of the insert, and has a generally lattice-like structure that allows air to pass freely therethrough. In an embodiment, the retainer 240 includes a mounting portion 242 that is sized and shaped to be received by the clasp 130 of the insert 30 in a manner such that the retainer 240 can be rotated about the clasp 130 between a first position, in which the retainer 240 overlays the second side 54 and the intake restricting element 180, and a second position, in which the retainer 240 is moved away from the second side 54 so as to allow access to the intake restricting element 180. In an embodiment, the retainer 240 includes a groove 244 that is sized, shaped, and positioned so as to engage the catch 136 protruding from the ridge 50 of the insert 30 when the retainer 240 is in its first position, thereby providing resistance to motion of the retainer 240 away from its first position. In an embodiment, the retainer 240 includes first and second cutouts 246, 248 that are sized, shaped, and positioned so as to overlay the post 124 and the hole 126, respectively, of the second side 54 of the exterior surface 34 of the insert 130.

Continuing to refer to FIGS. 5A and 5B, in an embodiment, the device 10 includes a cap 250 having a profile similar to that of the insert 30. In an embodiment, the cap 250 has an interior surface 252, an exterior surface 254, an upper end 256, and a lower end 258 opposite the upper end 256. In an embodiment, a flange 260 extends about the entire perimeter of the interior surface 252. In an embodiment, the flange 260 is sized and shaped to be complementary to the exterior flange 42 extending from the perimeter surface 36 of the insert 30, and thereby to facilitate attachment of the cap 250 to the insert 30. In an embodiment, the cap 250 is removably attached to the insert 30 to enable access to the internal elements of the device 10 (e.g., to enable replacement of the filter 160). In an embodiment, the cap 250 is permanently attached to the insert 30, such as through the use of an adhesive. In an embodiment, a projection 262 extends inwardly from the flange 260 at the upper end 256 of the cap 250 and is sized and shaped to be received within the indentation 138 of the insert 30.

Continuing to refer to FIGS. 5A and 5B, in an embodiment, the cap 250 includes a hole array 262 having a plurality of holes 264, each of which extends through the cap 250 from the interior surface 252 to the exterior surface 254. FIGS. 5A and 5B indicate only a single one of the holes 264 for the sake of clarity, but it will be apparent to those of skill in the art that the disclosure of a hole 264 or of holes 264 may refer to any of the holes 264 described herein and illustrated in FIGS. 5A and 5B. It will also be apparent to those of skill in the art that the specific size, shape, and positioning of the holes 264 forming the hole array 262 shown in FIGS. 1, 5A and 5B is only exemplary. In an embodiment, the hole array 262 is arranged so as to provide an aesthetically pleasing appearance to the device 10. In an embodiment, the hole array 262 is arranged in a substantially U-shaped arrangement.

Referring back to FIGS. 2 and 3, in an embodiment, the outer layer 12 includes straps 270, 272 extending in opposite directions away from a central portion 274. In an embodiment, the central portion 274 includes an aperture 276 that is sized and shaped to surround the perimeter surface 36 of the insert 30 and retain the insert 30 therein. In an embodiment, the outer layer 12 is made from a fabric material. In an embodiment, the outer layer 12 is made from an elastic material. In an embodiment, the size of the outer layer 12 is adjustable (e.g., the lengths of the straps 270, 272 are adjustable). In an embodiment, the straps 270, 272 include corresponding ends 278, 280. In an embodiment, the ends 278, 280 of the straps 270, 272 incorporate corresponding hook and loop fasteners 282, 284 to enable the ends 278, 280 to be secured to one another, thereby to enable the device 10 to be affixed about the user's head (see, e.g., FIG. 1). In other embodiments, the ends 278, 280 of the straps 270, 272 include other securing means known in the art, such as clips, press-fit snaps, buttons, or the like. In an embodiment, the straps 270, 272 include cutouts 286, 288 for seating around the user's ears to further secure the device 10 to the user's face.

In an embodiment, at least one of the insert 30, the intake restricting element 180, the adjustment wheel 220, the retainer 240, and the cap 250 is made from a polycarbonate ("PC") plastic. In an embodiment, at least one of the insert 30, the intake restricting element 180, the adjustment wheel 220, the retainer 240, and the cap 250 is made from a nylon plastic. In an embodiment, at least one of the insert 30, the intake restricting element 180, the adjustment wheel 220, the retainer 240, and the cap 250 is made from a polypropylene plastic. In an embodiment, at least one of the insert 30, the intake restricting element 180, the adjustment wheel 220, the retainer 240, and the cap 250 is made from another material selected such that they are capable of use as described herein. In an embodiment, all of the insert 30, the intake restricting element 180, the adjustment wheel 220, the retainer 240, and the cap 250 are made from the same material. In an embodiment, one or more of the insert 30, the intake restricting element 180, the adjustment wheel 220, the retainer 240, and the cap 250 is made from a different material. In an embodiment, at least one of the insert 30, the intake restricting element 180, the adjustment wheel 220, the retainer 240, and the cap 250 is made from a translucent material. In an embodiment, at least one of the insert 30, the intake restricting element 180, the adjustment wheel 220, the retainer 240, and the cap 250 is made from an opaque material.

Referring now to FIGS. 5A-6C, assembly of the device 10 is described. The insert 30 is inserted into the aperture 22 of the face mask 14 such that the lip 24 of the face mask 14 is received between the interior flange 38 and intermediate flange 40 of the insert 30. The elastic nature of the face mask 14 retains the insert 30 within the aperture 22 in an airtight engagement. In an embodiment, the face mask 14 and the insert 30 are integrally formed with one another by an overmolding process. When the face mask 14 and the insert 30 are so formed, the entire periphery of the interior flange 38 of the insert 30 is disposed within the groove 26 of the lip 24 of the face mask 14, and the material of the face mask 14 extends through each of the perforations 42 that are formed in the interior flange 38 of the insert 30. The elastic nature of the face mask 14, coupled with the overmolding as described above, retains the insert 30 within the aperture 22 (and, more particularly, within the groove 26) in an engagement that is air-tight and structurally secure. However, for clarity of illustration, the face mask 14 is not shown in FIGS. 4A-5C.

Continuing to refer to FIGS. 5A-6C, the membranes 140, 142, 144, 146 are affixed to the insert 30 by placing the central apertures 150, 152, 154, 156 thereof over the corresponding posts 104, 106, 108, 110. In an embodiment, the posts 104, 106, 108, 110 include bulbous portions opposite the corresponding biasing elements 88, 90, 92, 94, which are configured to retain the membranes 140, 142, 144, 146 thereon.

Continuing to refer to FIGS. 5A-6C, the intake restricting element 180 is positioned over the insert 30 by positioning the fin 216 of the intake restricting element 180 under the guide 132 of the insert 30, then lowering the post 190 of the intake restricting element 180 into the hole 126 of the insert 30. The adjustment wheel 220 is positioned over the insert by lowering the hole 228 of the adjustment wheel 220 over the post 124 of the insert 30 while the teeth 234 of the adjustment wheel 220 are positioned so as to mesh with the teeth 210 of the intake restricting element 180. The rivet 238 is secured in the bore 125 of the insert 30 to affix the adjustment wheel 220 to the insert 30. The post 190 of the intake restricting element 180 is secured in the hole 126 of the insert 30 by "heat staking," i.e., by melting a portion of the post 190 at an end of the post 190 that protrudes past the interior surface 32 of the insert 30, thereby to form a cap that retains the post 190 in proximity to the insert 30.

Continuing to refer to FIGS. 5A-6C, the retainer 240 is attached to the insert 30 by positioning the mounting portion 242 of the retainer 240 within the clasp 130 of the insert 30. The filter 144 is placed over the intake restricting element 180 and is secured in place by pivoting the retainer 240 to the first position discussed above, such that the groove 244 of the retainer 240 receives the catch 136 of the insert 30, thereby retaining the retainer 240 in the first position and securing the filter 144 in proximity to the intake restricting element 180.

Referring now to FIGS. 1-3, the cap 250 is engaged to the insert 30 by engaging the flange 260 of the cap 250 with the exterior flange 42 of the insert 30. During such engagement, the projection 262 of the cap 250 may be aligned with the indentation 138 in the perimeter surface 36 of the cap to facilitate proper alignment of the cap 250 with respect to the insert 30. The cap 250 may be permanently fixed to the insert 30 (e.g., through the use of an adhesive), or may be removable therefrom. The outer layer 12 is laid over the face mask 14, which has the insert 30 retained therein. The aperture 276 of the outer layer 12 is stretched and placed over the insert 30 such that the aperture 276 surrounds the perimeter surface 36 of the insert 30, and then allowed to return to its relaxed (i.e., not stretched) size such that the aperture 276 of the outer layer 12 retains the insert 30, and thus the face mask 14, therein.

Referring now to FIGS. 1 and 6A through 6C, use of the exemplary device 10 by a user according to an exemplary embodiment will now be described. Initially, the device 10 is affixed to the user's face by placing the face mask 14 over the user's mouth and nose, passing the straps 270, 272 around either side of the user's head such that the cutouts 286, 288 overlap the user's ears, and securing the ends 278, 280 to one another using the hook and loop fasteners 282, 284. The user may adjust the hook and loop fasteners 282, 284 to ensure that the face mask 14 is pulled against the user's face with sufficient force such that the perimeter 16 thereof is pressed tightly against the user's face and around the user's mouth and nose. By such action, an airtight seal is created between the user's face and the face mask 14, thereby ensuring that air can only pass in and out for the user's inhalation and exhalation through the various apertures formed within the insert 30.

Figure 6A:
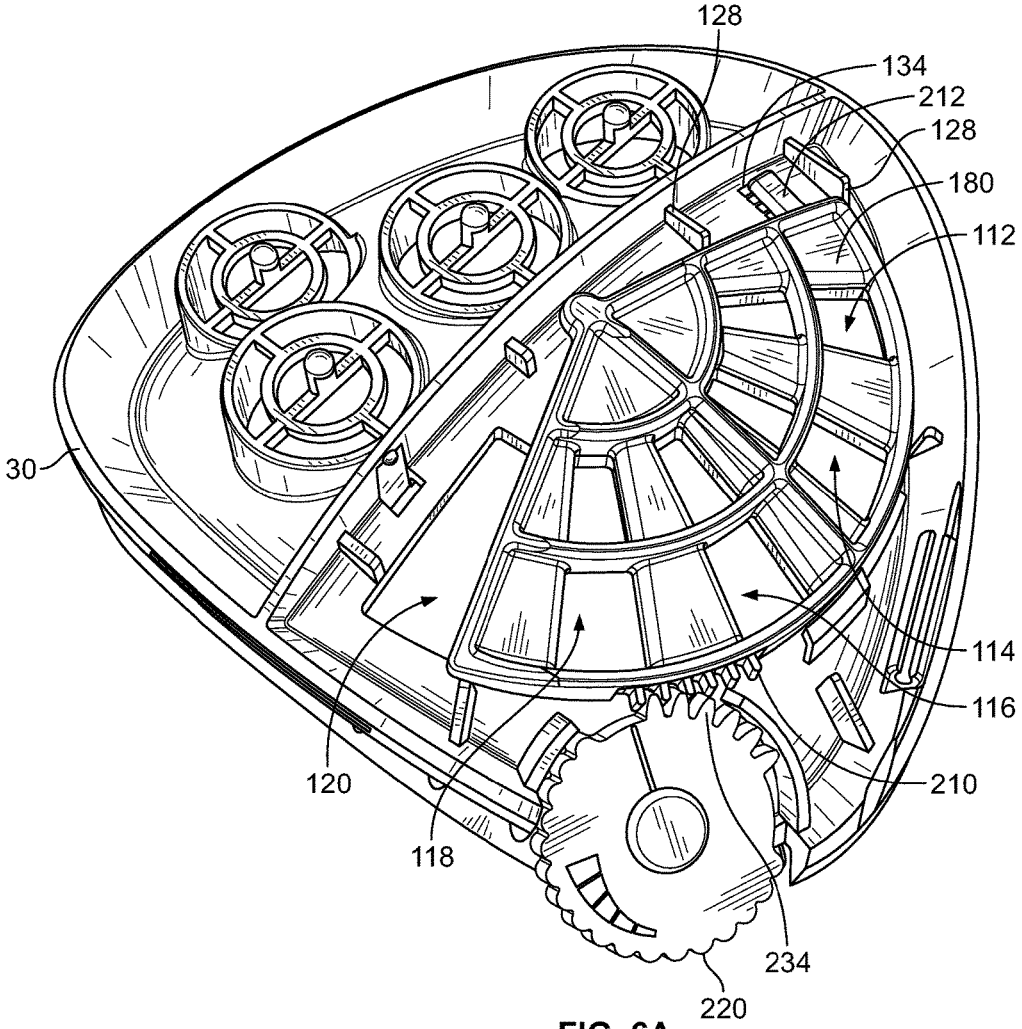
FIG. 6A is an assembled front perspective view of some of the elements shown in FIG. 5A, said elements being configured in a first position.
Figure 6B:
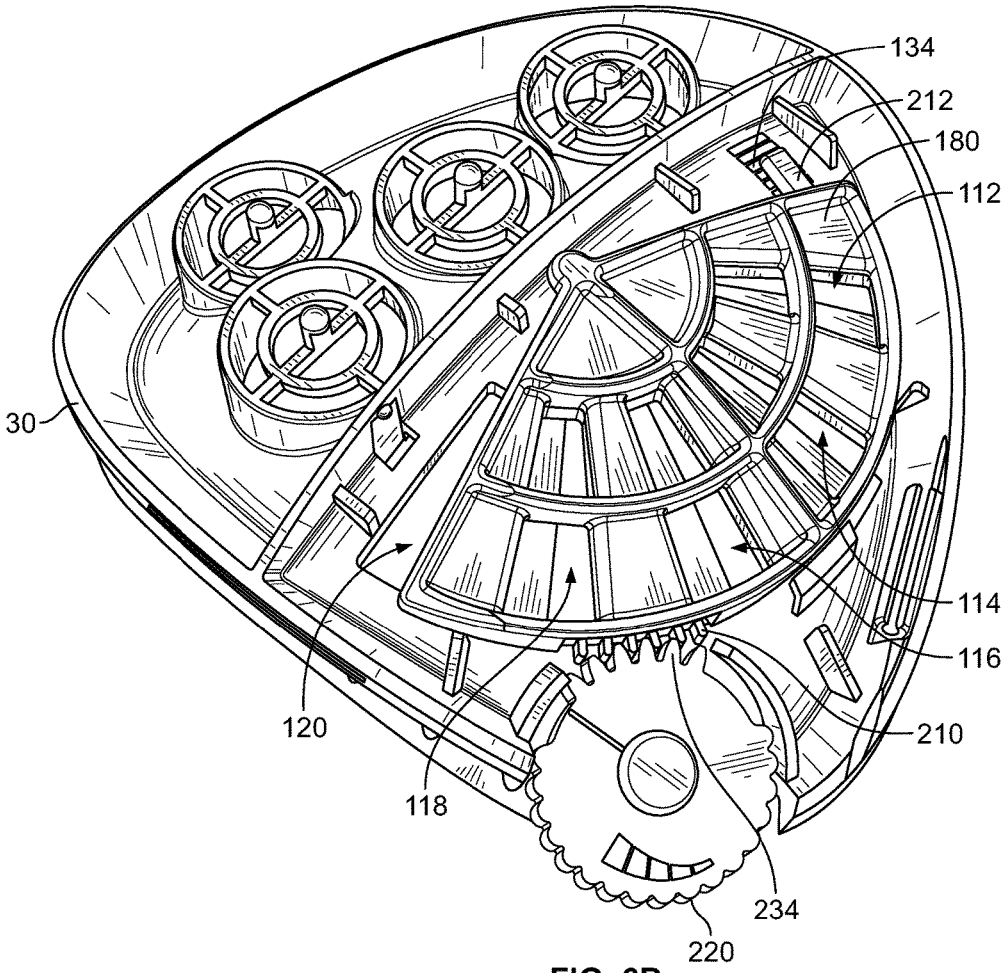
FIG. 6B is an assembled front perspective view of the elements shown in FIG. 6A, said elements being configured in a second position.
Figure 6C:
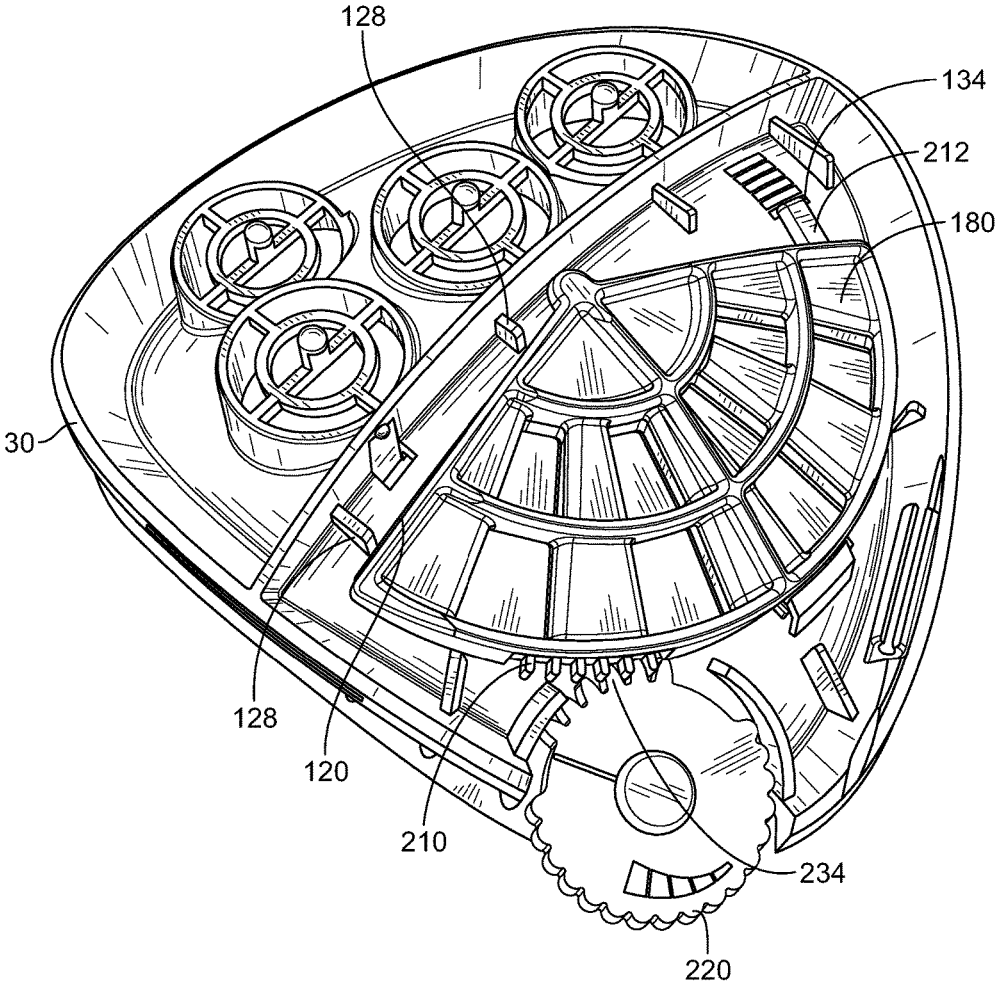
FIG. 6C is an assembled front perspective view of the elements shown in FIG. 6A, said elements being configured in a third position.

Referring now to FIGS. 6A through 6C, adjustment of the exemplary device 10 by a user will now be described. More particularly, FIGS. 6A, 6B, and 6C illustrate certain elements of the device 10 (including the insert 30, the intake restricting element 180, and the adjustment wheel 240) with other elements of the device 10 (including, most relevantly, the cap 250) omitted for clarity. FIG. 6A shows a first position of the intake restricting element 180 with respect to the insert 30. Specifically, the intake restricting element 180 is positioned such that the arm 212 abuts the ridge 50 of the insert 30. When the intake restricting element 180 is so positioned, the ridge 214 of the arm 212 is aligned with and rests within the one of the grooves 134 that is closest to the ridge 50. Also, when the intake restricting element 180 is so positioned, each of the apertures 200, 202, 204, 206 of the intake restricting element 180 overlaps the entirety of a corresponding one of the apertures 112, 114, 116, 118 of the insert 30 and the intake restricting element 180 does not cover the aperture 120 of the insert 30, which does not correspond to any of the apertures 200, 202, 204, 206 of the intake restricting element 180. Consequently, a comparatively large volume of air may pass through the aligned pairs of the apertures 200, 202, 204, 206 of the intake restricting element 180 with the corresponding one of the apertures 112, 114, 116, 118 of the insert 30 and through the exposed aperture 120 of the insert 30.

Referring now to FIG. 6B, in some circumstances, the user may wish to decrease the volume of air that may pass into the face mask 14. In this case, the user may manipulate the adjustment wheel 220, with the grips 236 aiding the user's ability to do so, and may rotate the adjustment wheel 220 in a counterclockwise direction as viewed from the perspective shown in FIGS. 6A through 6C. Such rotation of the adjustment wheel 220 and, consequently, the teeth 234 thereof drives corresponding motion of the teeth 210 of the intake restricting element 180, thereby causing the corresponding clockwise rotation of the intake restricting element 180. As the intake restricting element 180 rotates in a direction such that the arm 212 moves away from the ridge 50 of the insert 30, a smaller portion of each of the apertures 200, 202, 204, 206 of the intake restricting element 180 will overlap the corresponding one of the apertures 112, 114, 116, 118 of the insert 30 and a portion of the intake restricting element 180 covers the aperture 120 of the insert 30. Consequently, a correspondingly smaller volume of air may pass through the aligned pairs of the apertures 200, 202, 204, 206 of the intake restricting element 180 with the corresponding one of the apertures 112, 114, 116, 118 of the insert 30 and the exposed portion of the aperture 120 of the insert 30. Referring now to FIG. 6B, the intake restricting element 180 is shown in an intermediate position in which the ridge 214 of the arm 212 is aligned with and rests within an intermediate one of the grooves 134 of the insert 30.

Referring now to FIG. 6C, if the user wishes to allow an even smaller degree of air flow into the face mask 14, the user may continue to rotate the adjustment wheel 220 until the intake restricting element 180 has been driven to such an extent that the arm 212 has moved as far as possible away from the ridge 50 of the insert 30. In some embodiments, at least one of the stops 128 of the insert 30 defines such maximum allowable travel. When the intake restricting element 180 is so positioned, only a very small portion of each of the apertures 200, 202, 204, 206 of the intake restricting element 180 overlaps the corresponding one of the apertures 112, 114, 116, 118 of the insert 30, and only a very small portion of the aperture 120 of the insert 30 is exposed by the intake restricting element 30. Consequently, a still smaller volume of air may pass through the aligned pairs of the apertures 200, 202, 204, 206 of the intake restricting element 180 with the corresponding one of the apertures 112, 114, 116, 118 of the insert 30 and the exposed portion of the aperture 120 of the insert 30. Continuing to refer to FIG. 6C, the intake restricting element is shown in a position in which the ridge 214 of the arm 212 rests in the one of the grooves 134 that is furthest from the ridge 50 of the insert 30.

Referring now to FIGS. 1 through 6C, when the user inhales, a reduced air pressure is induced within the face mask 14 as compared to the surrounding atmosphere. This reduced air pressure urges the membranes 140, 142, 144, 146 against the corresponding biasing elements 88, 90, 92, 94, in which position the membranes 140, 142, 144, 146 completely overlap and seal the corresponding apertures 80, 82, 84, 86. Due to such sealing, air cannot pass from the user's surroundings to within the face mask 14 through the apertures 80, 82, 84, 86. As a result, the only air that can pass from the user's surroundings to within the face mask 14 is air allowed to pass through the portions of the apertures 112, 114, 116, 118 of the insert 30 that are aligned with the corresponding apertures 200, 202, 204, 206 of the intake restricting element, or through the portion of the aperture 120 of the insert 30 that is not covered by the intake restricting element 180. As described above, the user of the device 10 may configure the size of the portions of the apertures 112, 114, 116, 118, 120 of the insert that are exposed in this manner by rotating the adjustment wheel 220 to drive corresponding rotation of the intake restricting element 180 with respect to the insert 30. Therefore, by adjusting the position of the adjustment wheel 220, the user of the device 10 may control the amount of air that the device 10 allows him or her to inhale.

Continuing to refer to FIGS. 1 through 6C, when the user exhales, an increased air pressure is induced within the face mask 14 as compared to the surrounding atmosphere. This increased air pressure urges the membranes 140, 142, 144, 146 away from corresponding biasing elements 88, 90, 92, 94 of the insert 30, in which position the membranes 140, 142, 144, 146 do not seal the circular apertures 80, 82, 84, 86 of the insert 30. Due to such lack of sealing, exhaled air can freely pass from within the face mask 14 to the user's surroundings through the circular apertures 80, 82, 84, 86 of the insert 30 and the slots 304 of the face plate 280. Because the combination of the membranes 140, 142, 144, 146, the biasing elements 88, 90, 92, 94, and the circular apertures 80, 82, 84, 86 cooperate to allow the user exhale freely therethrough, while preventing air inhalation therethrough, this combination of elements may be considered to form an air exhaust valve assembly.

The resistance breathing device 10 restricts the volume of air that can be inhaled by a user during ventilation to the volume of air that can pass through the portions of the apertures 112, 114, 116, 118, 120 of the insert 30 that are not obscured by the intake restricting element 180. Consequently, the resistance breathing device 10 restricts the oxygen available to the user's body when the device 10 is worn by the user. Users who wear the resistance breathing device 10 during physical training may realize improved benefits from such physical training due to such restriction. Moreover, because the user may select the position of the intake restricting element 180 as described above, and thereby select the sizes of the portions of the apertures 112, 114, 116, 118, 120 of the insert 30 that are not obscured by the intake restricting element 180, the user may select the degree of restriction of inhalation of oxygen to be provided by the resistance breathing device 10.

As the filter 160 overlays the apertures 112, 114, 116, 118, 120 of the insert 30, any air that passes from outside the face mask 14 to within the face mask 14 through the apertures 112, 114, 116, 118, 120 is filtered by the filter 160. As a result, airborne particulate matter (e.g., dust, sand, etc.) is filtered therefrom. Because of the air-tight seal between the perimeter 16 of the face mask 14 and the user's face, and because of the sealing of the circular apertures 80, 82, 84, 86 of the insert 30 by the corresponding membranes 140, 142, 144, 146 when the user inhales, air passing through the filter 160 is the only air that may pass from outside the device 10 to within the face mask 14 and be inhaled by the user. As a result, the air inhaled by the user may be substantially free of particulate matter, preventing such particulate matter from entering the user's throat and lungs and causing symptoms such as coughing and congestion.

It will be understood that the embodiments described herein are merely exemplary and that a person skilled in the art may make many variations and modifications without departing from the spirit and scope of the invention. All such variations and modifications are intended to be included within the scope of the invention, as embodied in the appended claims presented.

What is claimed is:

1. A resistance breathing device, comprising:

a face mask having an interior surface, an exterior surface opposite said interior surface, and at least one inlet aperture of said face mask extending from said exterior surface to said interior surface;

an intake restricting element including at least one inlet aperture of said intake restricting element, said intake restricting element being movably positioned adjacent to said face mask, said intake restricting element being movable rotatably between at least a first position, wherein a first portion of said at least one inlet aperture of said intake restricting element overlays a first portion of said at least one inlet aperture of said face mask, and a second position, wherein a second portion of said at least one inlet aperture of said intake restricting element overlays a second portion of said at least one inlet aperture of said face mask, said second portion of said at least one inlet aperture of said intake restricting element being larger in size than said first portion of said at least one inlet aperture of said intake restricting element;

an adjustment mechanism attached to said face mask such that said adjustment mechanism is movable between at least a first position of said adjustment mechanism and a second position of said adjustment mechanism, said first position of said adjustment mechanism corresponding to said first position of said intake restricting element, said second position of said adjustment mechanism corresponding to said second position of said intake restricting element, wherein said adjustment mechanism includes an adjustment wheel; and a filter overlaying said at least one inlet aperture of said face mask.

2. The resistance breathing device of claim 1, wherein motion of said adjustment mechanism between its said first position and its said second position causes corresponding motion of said intake restricting element between its said first position and its said second position.

3. The resistance breathing device of claim 1, wherein said intake restricting element includes a first plurality of teeth and said adjustment wheel includes a second plurality of teeth, said intake restricting element and said adjustment wheel being positioned adjacent to one another such that said first plurality of teeth of said intake restricting element meshes with said second plurality of teeth of said adjustment wheel.

4. The resistance breathing device of claim 1, further comprising a retainer movably attached to said face mask, said retainer being movable between at least a first position of said retainer, wherein said retainer retains said filter in proximity to said face mask, and a second position of said retainer, wherein said retainer enables said filter to be removed from said face mask.

5. The resistance breathing device of claim 1, wherein said face mask includes a plurality of grooves formed in said exterior surface of said face mask and spaced apart from one another, said intake restricting element including an arm extending therefrom and a ridge projecting from said arm, said ridge of said intake restricting element being positioned within a first one of said plurality of grooves of said face mask when said intake restricting element is in its said first position, and said ridge of said intake restricting element being positioned within a second one of said plurality of grooves of said face mask when said intake restricting element is in its said second position.

6. The resistance breathing device of claim 5, wherein said ridge of said intake restricting element and said plurality of grooves of said face mask are sized and shaped such that when said ridge is positioned within one of said plurality of grooves, said ridge and said one of said plurality of grooves cooperate to resist rotational movement of said intake restricting element.

7. The resistance breathing device of claim 1, wherein said face mask includes a hole defining a rotational axis, said intake restricting element including a post, and said hole of said face mask receives said post of said intake restricting element such that the rotational movement of said intake restricting element with respect to said face mask is about said rotational axis of said hole.

8. The resistance breathing device of claim 7, wherein said at least one inlet aperture of said face mask includes a plurality of inlet apertures and said at least one inlet aperture of said intake restricting element includes a plurality of inlet apertures, each of said plurality of inlet apertures of said intake restricting element corresponds to one of said plurality of inlet apertures of said face mask, wherein when said intake restricting element is in its said first position, a first portion of each of said plurality of inlet apertures of said intake restricting element overlays a first portion of said corresponding one of said plurality of inlet apertures of said face mask, and when said intake restricting element is in its said second position, a second portion each of said plurality of inlet apertures of said intake restricting element overlays a second portion of said corresponding one of said plurality of inlet apertures of said face mask, said second portion of each of said plurality of inlet apertures of said intake restricting element being larger in size than said first portion of each of said plurality of inlet apertures of said intake restricting element.

9. The resistance breathing device of claim 8, wherein said plurality of inlet apertures of said intake restricting element are arrayed about said post of said intake restricting element in an arcuate arrangement.

10. The resistance breathing device of claim 9, wherein at least one of said plurality of inlet apertures of said intake restricting element includes an annular sector shape.

11. The resistance breathing device of claim 8, wherein said plurality of inlet apertures of said face mask are arrayed about said hole of said face mask in an arcuate arrangement.

12. The resistance breathing device of claim 11, wherein at least one of said plurality of inlet apertures of said face mask has an annular sector shape.

13. The resistance breathing device of claim 8, wherein each of said plurality of inlet apertures of said intake restricting element is identically sized and shaped to said corresponding one of said plurality of inlet apertures of said face mask.

14. The resistance breathing device of claim 1, wherein a size of said at least one inlet aperture of said intake restricting element is equal to a size of said at least one inlet aperture of said face mask.

15. The resistance breathing device of claim 1, further comprising an air exhaust assembly configured to prevent air from passing therethrough from an external environment to an internal area of said face mask and to allow air to pass therethrough from said internal area of said face mask to the external environment.

16. The resistance breathing device of claim 15, wherein said air exhaust assembly includes at least one outlet aperture positioned offset from said at least one inlet aperture of said face mask and at least one membrane, each of the at least one membrane overlaying a corresponding one of the at least one outlet aperture so as to allow air to pass through the at least one outlet aperture from said internal area of said face mask to the external environment and to prevent air from passing through the at least one outlet aperture from the external environment to said internal area.

17. The resistance breathing device of claim 16, wherein each of said at least one outlet aperture includes a biasing member extending across said one of said at least one outlet aperture of said face mask and a stem extending from a center of said biasing member and away from said face mask, wherein each of said at least one membrane has a hole extending therethrough, and wherein the stem of each of the at least one outlet aperture is positioned within the hole of the corresponding one of the at least one membrane.

* * * * *